US007516832B2

(12) United States Patent
Dobbins

(10) Patent No.: US 7,516,832 B2
(45) Date of Patent: Apr. 14, 2009

(54) TWO DOOR ELECTRONIC SAFE

(75) Inventor: Bob M. Dobbins, Villanova, PA (US)

(73) Assignee: Ellenby Technologies, Inc., Woodbury Heights, NJ (US)

( * ) Notice: Subject to any disclaimer, the term of this patent is extended or adjusted under 35 U.S.C. 154(b) by 844 days.

(21) Appl. No.: 10/912,753

(22) Filed: Aug. 5, 2004

(65) Prior Publication Data

US 2005/0040005 A1 Feb. 24, 2005

Related U.S. Application Data

(60) Provisional application No. 60/496,515, filed on Aug. 20, 2003.

(51) Int. Cl.

| | |
|---|---|
| ***G07F 9/10*** | (2006.01) |
| ***E05G 1/00*** | (2006.01) |
| ***E05G 1/024*** | (2006.01) |
| ***E05G 1/026*** | (2006.01) |

(52) U.S. Cl. ..... 194/350; 109/53; 109/67

(58) Field of Classification Search ..... 194/350; 109/45, 49, 53–56, 67, 68; 312/295, 324, 312/321.5

See application file for complete search history.

(56) References Cited

U.S. PATENT DOCUMENTS 1,241,279 A * 9/1917 Pyle ..... 312/308
4,655,368 A * 4/1987 Bateman et al. ..... 221/4
4,662,621 A * 5/1987 Lundblad ..... 271/3.19
5,202,825 A 4/1993 Miller et al.
5,615,625 A * 4/1997 Cassidy et al. ..... 109/45
5,616,902 A * 4/1997 Cooley et al. ..... 235/380
5,653,436 A * 8/1997 Zouzoulas ..... 271/177
5,701,828 A * 12/1997 Benore et al. ..... 109/56
5,740,897 A * 4/1998 Gauselmann ..... 194/206
6,039,164 A * 3/2000 Waters et al. ..... 194/206
6,067,530 A 5/2000 Brooks, Jr. et al.
6,328,208 B1 12/2001 Artino et al.
6,443,359 B1 9/2002 Green et al.
6,871,601 B2 * 3/2005 Stinson ..... 109/24.1
6,941,274 B1 * 9/2005 Ramachandran et al. ..... 705/26

* cited by examiner

*Primary Examiner*—Patrick H. Mackey
*Assistant Examiner*—Mark Beauchaine
(74) *Attorney, Agent, or Firm*—Priest & Goldstein, PLLC

(57) ABSTRACT

A two door electronic safe is described wherein a bill acceptor, as well as other electronic control circuitry, and a banknote canister are partitioned in first and second compartments with access by first and second access doors, respectively, so that a service call can be made to service the bill acceptor or other electronics without having to allow access to the banknote canister thereby facilitating service calls and allowing the separation of the service call function from the cash collection function.

14 Claims, 5 Drawing Sheets

TWO DOOR ELECTRONIC SAFE

The present application claims the benefit of U.S. Application Ser. No. 60/496,515 filed Aug. 20, 2003 which is incorporated by reference herein in its entirety.

FIELD OF THE INVENTION

The present invention relates generally to advantageous aspects of an improved electronic drop safe. More particularly, the present invention relates to such a safe with separate access to a serviceable electronics area and a stored currency area of the safe.

BACKGROUND OF THE INVENTION

The use of electronic drop safes in applications in which cash is a significant payment media results in increased security for cashiers and store managers, as well as, reducing the risk of robbery or theft of the cash stored in such safes. There are a number of products on the market, such as the Ellenby Technologies, Inc. CashTrak Electronic Safe™. Although this class of safe is not considered a security safe since there are openings in the unit to allow access to currency or bills, it is effective in securing both the currency and the employees handling currency in attended locations. Such an electronic safe typically uses an electronic bill acceptor which accepts currency and stacks the currency inside the safe. The safe's electronic controller keeps track of the amount of currency deposited, who deposited the currency, and when it was deposited. In addition to the security provided by these products, the cost is also justified by the management time saved, as money does not have to be sorted and counted by the manager. The electronic safe provides the reporting required to give the manager all the information required. Many of these safes are tied to a back room system or point of sale (POS) system and the information is directly transferred to the counting room, bank, or company headquarters as required by the particular application.

A more detailed understanding of the operation of one such electronic safe can be found in U.S. patent application Ser. No. 09/960,595 filed Sep. 21, 2001 and assigned to the assignee of the current invention which is incorporated herein by reference in its entirety.

One of the advantages of this class of electronic drop safe is its small size. Their small size allows them to be distributed or placed so that each cashier or POS system in a facility has one nearby. It is likely therefore for several of these safes to be located in a facility. A significant disadvantage of these safes is that in the event of a failure or bill jam, the electronic safe is out of service and cashiers either have to use another safe thus slowing down the time to complete a transaction or worse, a cashier may be forced to leave excess cash in the cash drawer. Of course, such a nonsecure buildup of cash, defeats the purpose of the electronic safe.

Adding to the problem is that unless the facility has the technical expertise to service the safe, an outside service provider has to be contacted to repair or replace the defective component. In many cases, the problem is centered on the bill acceptor as it has the only moving parts and suffers from wear. The high volume of bills many of these electronic safes receive will result in expected wear and tear issues, and preventive maintenance may typically be expected in six months to a year.

Even if repair or replacement can be done by the staff on premises, the current generation of electronic safes requires the safe to be opened to provide access to the bill acceptor and other electronic components that may be internal to the safe. This present arrangement has several problems. First, opening the safe door allows access to the cash. At the very least, the service person will have to wait to have a manager present to insure the money remains secure. Second, in many cases, just opening the door signals the electronic controller of the safe that a "collection" is being made. That is, that the money is being collected. In order to maintain the integrity of the system, the money will have to be collected in actuality at this time even if it is not a scheduled collection time. Such unscheduled collections result in cash sitting in the manager's office, or being put in another safe on the premises. If an armored carrier service is used and is responsible for collecting and counting all the cash, that service may have to be called to make an unscheduled and expensive pickup. Alternatively, the service person will have to schedule his or her service visit to coincide with availability of the appropriate manager, to coincide with a pickup of an armored carrier service, or the like, to have access to the safe for cash collection.

There are also other disadvantages of the current typical approach. These include the typical requirement that the keeper of the safe key be present when a service person arrives. The control of keys of course is critical to the security and accountability of the system. Even if an electronic lock is used and a code is used to access the safe, the keeper of the code is required to be present. Usually, this person is a manager or the collection service. Many retail operations require service to their equipment in a timely manner. Equipment going out of service impacts their business. It is not uncommon for a service company to have to respond within a day and in as little time as four hours. The current service issues as described above makes such rapid response difficult or even impossible. If the manager or collection service must also be present for a service person to have access to the safe, the available time for service is usually limited to the working or available hours of the manager or collection service. Typically, this period is during normal daytime working hours. Unfortunately, this period is also when these retail outlets are busiest. Such daytime access to the electronic safes by service persons disrupts normal business operation.

In addition to forcing access to the currency and the resulting complications as discussed above, most of the electronic safes manufactured today require tools to disassemble the bill acceptor from the safe and therefore it takes some time to complete a service call at the safe.

As discussed above, the security of current electronic safes is limited by the requirement that the bills are fed through an opening in the safe. In the event a thief wants access, this opening is the obvious place to attempt to gain access. Even if not successful, destroying the bill acceptor in an attempt to gain access results in a costly repair. The bill acceptor is the most costly component in the electronic safe. Peripheral damage to the safe box and other components adds to the cost of the repair.

SUMMARY OF THE INVENTION

Among its several and varied aspects, one objective of the current invention is to provide an electronic drop safe with separate access to the electronic components of the safe including the bill acceptor, on the one hand, and to the cassette housing the collected currency, on the other.

Another objective of the current invention is to provide an electronic drop safe in which service personnel's access to serviceable components is isolated or separated from access to collected currency stored in the electronic drop safe.

Yet, another objective of the current invention is to provide different electronic or mechanical keying for service personnel access from the keying for cash collection.

Another objective of the current invention is to provide an electronic drop safe with easy access and removal of serviceable components.

Yet, another objective of the current invention is to provide an electronic drop safe with easy access and quick removal of the cash canister.

It is also an objective of the current invention to allow access to the bill acceptor without access to collected cash for clearing of bill jams often without the use of tools.

Another objective of the current invention is to provide increased security against theft of the cash canister by eliminating the bill entry holes from the cash canister access door.

A further objective of the current invention is to provide access to the cash canister without allowing access to the electronics.

Other features and advantages of the present invention are described further below and will be readily apparent by reference to the following detailed description and accompanying drawings. It being recognized that the claims define the invention, and a given embodiment according to the claims may accomplish none, one, or several of the above discussed objectives more or less successfully, and that such objectives should not be seen as critical or essential absent their embodiment in the claims.

DETAILED DESCRIPTION

Figure 1:
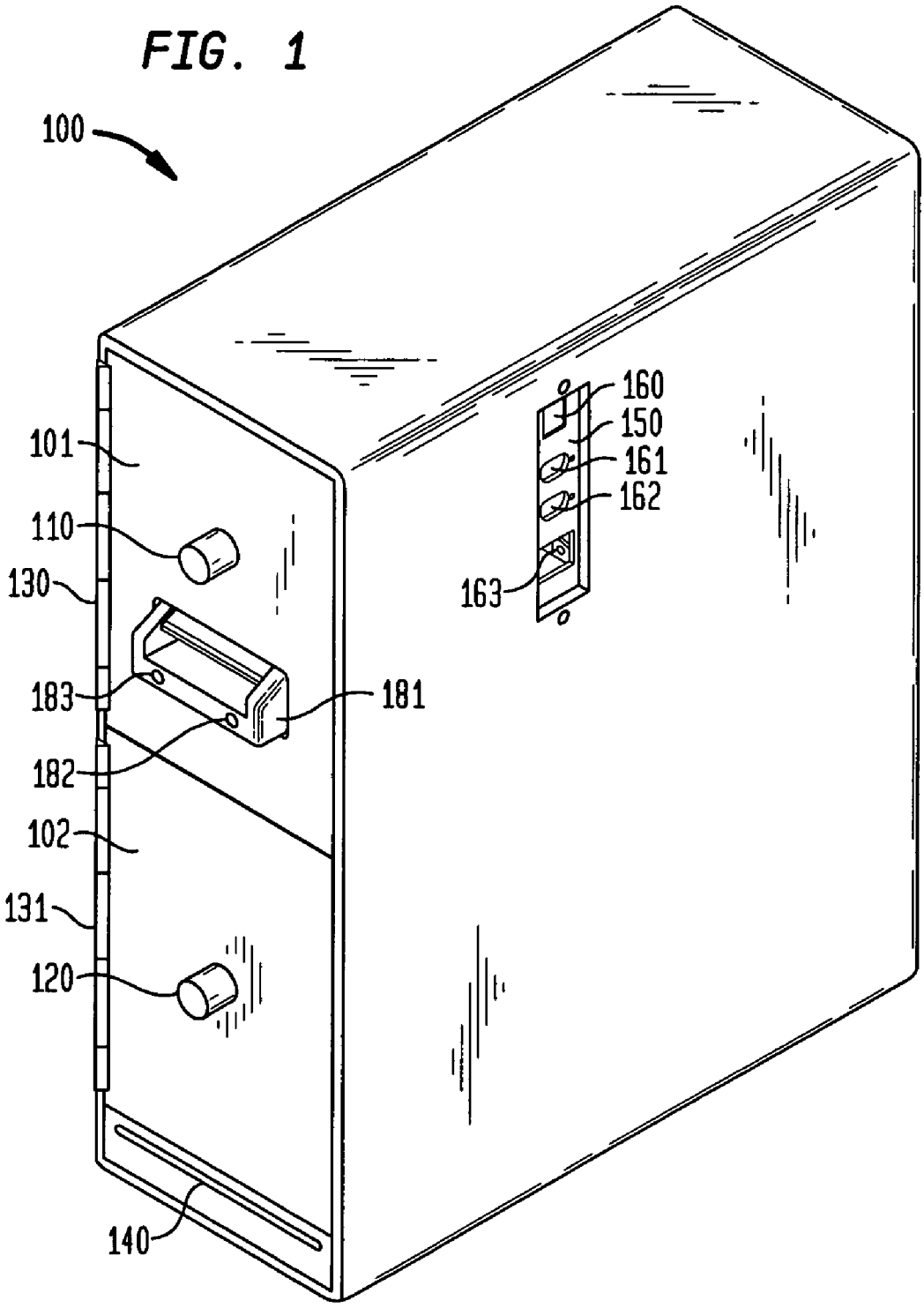
FIG. 1 shows a perspective view of a presently preferred embodiment of an electronic drop safe in accordance with the present invention.

Referring to FIG. 1, an electronic drop safe 100 in accordance with the present invention is shown in a perspective view. The safe 100 is typically made from ⅛" to ¼" steel with the doors constructed from ¼" to ½" steel. The size of the safe is designed so that it will conveniently fit under a counter near a cash register or POS terminal, although any convenient location is suitable. In a presently preferred embodiment, the safe height will be less than 20", its width about 6", and its depth about 15".

The electronic drop safe 100 is designed to be bolted in place with the bolts extending up into the safe from the flooring or base cabinetry. For this purpose, the safe base has multiple bolt clearance slots 190 and 191 best seen in FIGS. 2A and 2B. It will be recognized that other methods of mounting the safe can be used, and the particular approach to mounting does not serve as a limitation of this patent.

The electronic drop safe 100 is equipped with at least two doors 101 and 102 as shown in FIG. 1. Doors 101 and 102 provide independent access to each of the two major regions requiring access. Upper door 101 provides access to the bill acceptor module and safe electronics. Access thereto is controlled by a lock 110. The lock 110 can suitably be either a mechanical lock requiring a key or an electronic lock requiring a code, key or other access mechanism. Bill acceptor intake 181 extends through the access door 101 and is the inlet for inserting bills to be stored in a secure cassette as described further below.

The bill acceptor intake 181 will typically include indicator lights 182 and 183 to both draw attention to the bill intake region, and to provide some feedback to the user that the bill acceptor is powered and operational. The internal operation of the bill acceptor is outside the scope of this invention and several manufacturers provide suitable bill acceptor products. One such product is the MEI Cashflow SC Series Bill Acceptor™ product.

The second lower door 102 provides access to the cash canister. The operation and use of the cash canister will be discussed in further detail below. The cash access door 102 has its own lock 120 which can be mechanical or electronic which is generally keyed or coded differently than the lock 110 in door 101. Door 102 is preferably designed to have minimal or no openings to make forced entry difficult.

In many cases, it is desirable to allow the deposit of cash, checks, food stamps and the like without using the bill acceptor entry 181. To such ends, an envelope drop slot 140 can be provided for this purpose as shown in FIG. 1. In a preferred embodiment, envelopes or items deposited through the envelope drop slot 140 will also presently be accessible through the cash access door 102. Of course, a separate door can be provided for access to the manually dropped items if so desired.

The bill acceptor and other electronic components housed inside the safe 100 require power and control signals to operate. A cable access panel 150 is used to interface the internal components to power and other external components. Several types of interfaces can be provided and representative examples of these are shown in FIG. 1. Power for safe operation such as 120 VAC can be provided through an appropriate power connector that would be provided through an opening 163. In many cases, users of the electronic safe will enter their identification code through a separate control box located conveniently to the user. For example, the control box may sit on a checkout counter next to where the store employee stands. The electronic interface to such a separate control box can be through a connector such as an RJ11 phone style jack mounted in hole 160 or through a connector such as a DB9 computer style connector mounted in hole 161 or hole 162. Additional connections to peripheral devices such as a printer, a POS terminal or a backroom computer can also be made through connectors mounted in one of several openings such as the holes 160, 161, or 162. It should be clear that the number of openings provided for connectors can vary by application and need not be limited to those shown. It should also be clear that the external control box could include sophisticated electronics or be limited to a keypad and display or both. Also, the display and keypad can be mounted atop the safe and interconnected to an internal controller through openings not shown. Additional techniques for providing control signals to allow user access and peripheral interfaces are further described in U.S. patent application Ser. No. 09/960,595 assigned to the assignee of the present invention.

The access doors 101 and 102 are secured to the safe 100 with the use of hinges 130 and 131, respectively. Care must be taken to insure the integrity of these hinges so that they do not allow easy forced entry into the safe. The hinges used in a presently preferred embodiment are designed into the case of safe 100 so that the hinge pins are not accessible from outside the safe.

Figure 2A:
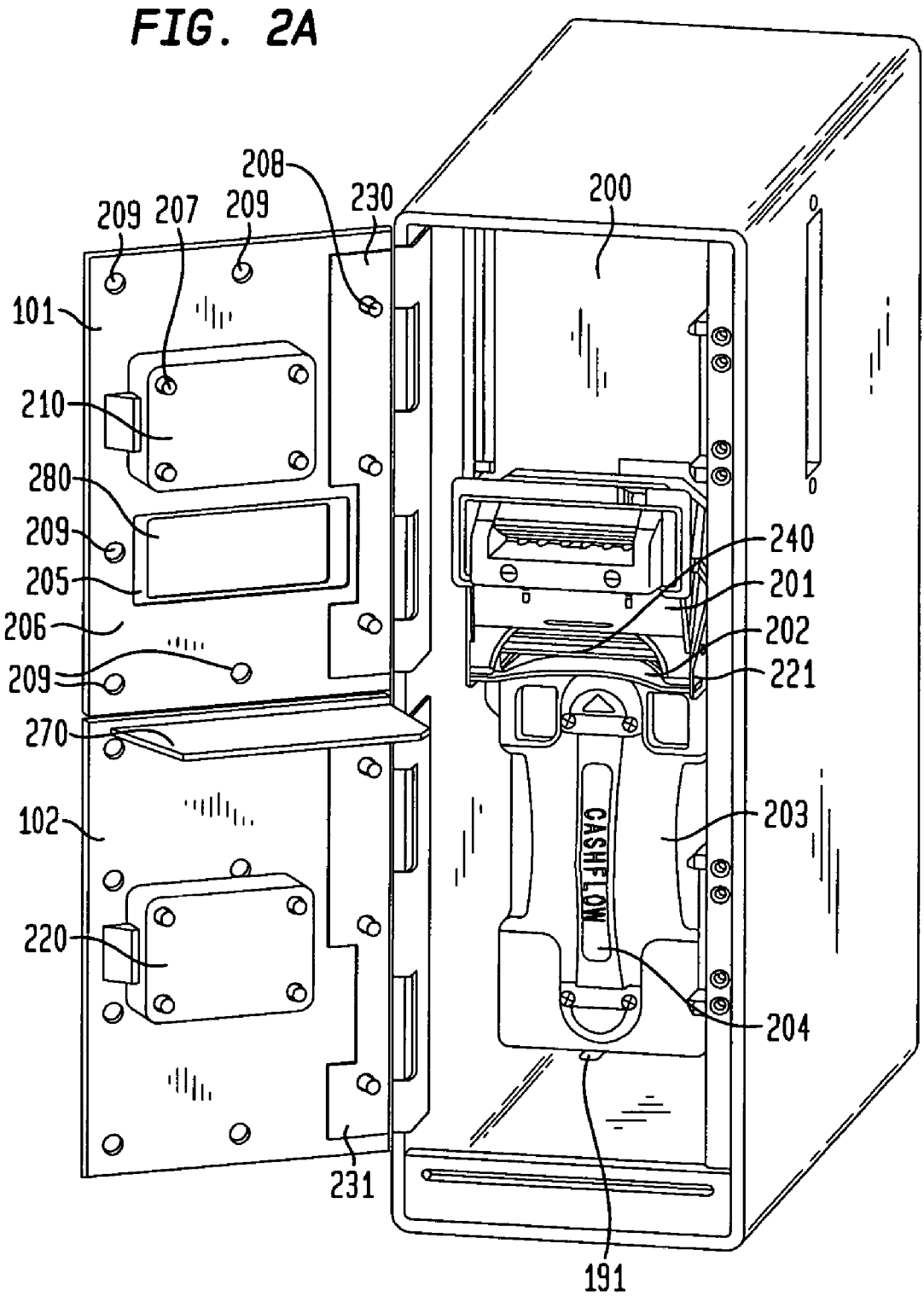
FIG. 2A shows the electronic drop safe with its access doors open.

Referring now to FIG. 2A, the safe 100 of the current invention is shown with both doors 101 and 102 open.

Mounted inside the safe is a bill acceptor unit 200 which consists of three major sections. These major sections are a bill acceptor module 201, a mounting frame 202 and a cash canister 203. The mounting frame 202 is securely fastened into the safe body. Depending on the manufacturer of the bill acceptor, the mounting may vary, but is not critical to the current invention. Bill acceptor units most suitable to the current invention will have a mounting frame, a bill acceptor module which includes the bill inlet, and a cash canister or cassette module each separately accessible as described herein. Several manufacturers provide such products.

Referring again to the bill acceptor mounting frame 202, the mounting of this module in safe 100 is arranged such that the bill acceptor module is separated from the cash canister module along a dividing plate which is part of the mounting frame 202. This dividing plate is positioned by the safe design to be aligned with the bottom of the top door 101 and the top of the bottom door 102. Further, the cash access door 102 is provided with a reinforcement shelf 270 which is designed to minimize the opening between the bill acceptor module 201 and the cash canister module 203 when the door 102 is closed.

The bill acceptor module 201 can be removed form its frame 202 by lifting a rod 240 which in its downward position locks the bill acceptor module 201 in place inside slots 221. Once the rod 240 is lifted, the bill acceptor module can be removed by pulling outward on the assembly. Once removed, the bill acceptor module 201 preferably allows complete access to the bill path for the purpose of cleaning or clearing jams without the use of tools. Hence, once the bill acceptor module 201 is removed, it can easily be cleaned, cleared or replaced without tools very quickly.

The cash canister 203 is removable from the frame module 202 by pulling outwardly on the cash canister module 203 using its handle 204. It is replaceable by aligning the cash canister module 203 to guide rails, not shown, on the frame module 202 and pushing inward until it snaps in place. The removal and replacement of the cash canister module 203 is fast and simple and requires no additional tools or skills.

Referring now to open door 101 in FIG. 2A, a preferred embodiment of the construction is described. The door 101 is made from a first metal component 203 which is typically ⅛" steel. A second metal component 206 is also made typically of ⅛" steel. Thus the total door thickness is ¼" in the current example. Of course, other thicknesses and material can be used to achieve thicker or thinner total door material. The current two part design approach allows the various mounting studs shown typically as lock 210 mounting studs 207 and hinge 230 mounting studs 208 to be mounted into the second metal component 206 without having access from the outside of the safe as these studs are covered by the first metal component 205. Thus, whether PEM studs, bolted standoffs or welded standoffs are used to achieve the studs shown, these potential access points are not discernable by a vandal from the outside of the safe. The first metal component 205 and the second metal component 206 can be welded together at the openings in the second metal component 206 as shown at multiple positions 209. An opening 280 in the access door 101 aligns with the bill inlet slot of the bill acceptor module 201 when the door is closed.

The hinges 230 and 231 are shown in their mounted positions on each of access doors 101 and 102 in FIG. 2A. The half of each of these hinges connecting to the safe box is preferably welded inside the safe box. The door halves of these hinges are shown mounted to their respective doors on the studs 208 discussed previously. This approach allows for manufacturing tolerances for each assembly by using nuts on the studs as shown. Additionally, doors can easily be replaced to allow for other options, locks, or the like without having to unbolt the entire safe.

The assembly and mounting of the cash access door 102 is similar to that described above for bill acceptor access door 101. Each of the access doors 101 and 102 have locks mounted to them on the studs 207 described above. As mentioned earlier, the type of lock used is not restricted by the current invention and any suitable lock can be used. In a presently preferred embodiment, the locks used are manufactured by LaGard Locks with mechanical key barrels manufactured by Medeco Locks.

Figure 2B:
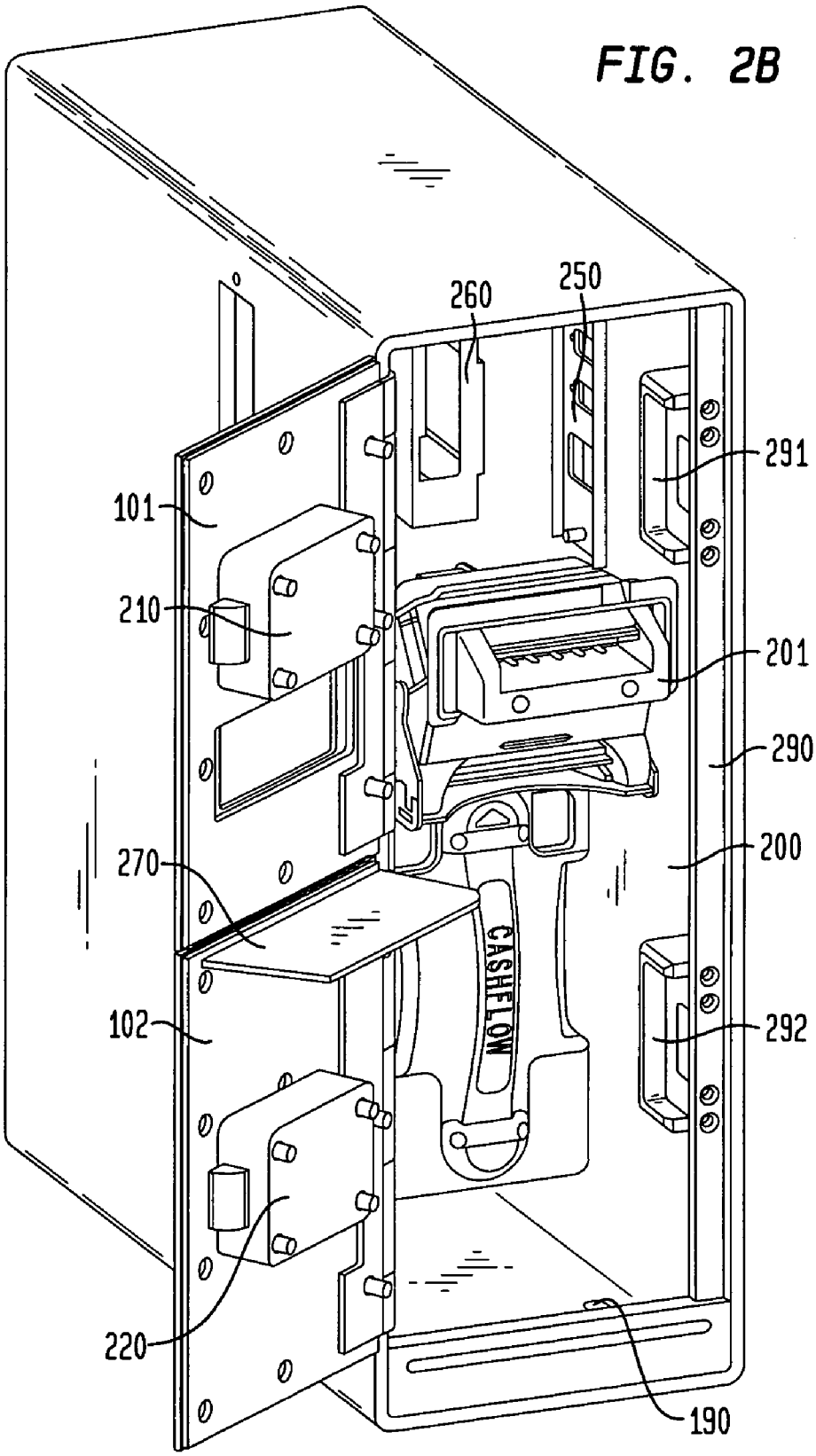
FIG. 2B shows another view of the electronic drop safe with its access doors open.

Referring now to FIG. 2B, another perspective view of the safe 100 of the current invention is shown. Each of doors 101 and 102 will close resting on rail or stop 290. Mounted to rail 290 are lock protectors 291 and 292. These lock protectors shield the locking tongues of each of locks 210 and 220 respectively. When locked, the shields prevent the use of tools from the top or front of the safe from retracting the locking tongues and opening the safe.

The electronic components required to operate the electronic safe are shown mounted behind the bill acceptor access door 101. A housing 260 for the electronic components is shown mounted behind the bill acceptor module 201 and may be suitably mounted on the inside wall using Velcro, not shown. Any easy disconnect mounting mechanism can be used to allow easy removal of the electronic control module. The interface between the module 201, the bill acceptor unit 200 and the external components including the power input will be connected through connection plate 250. Wiring cables and specific connectors are not shown and are not specific to the current invention.

Figure 3:
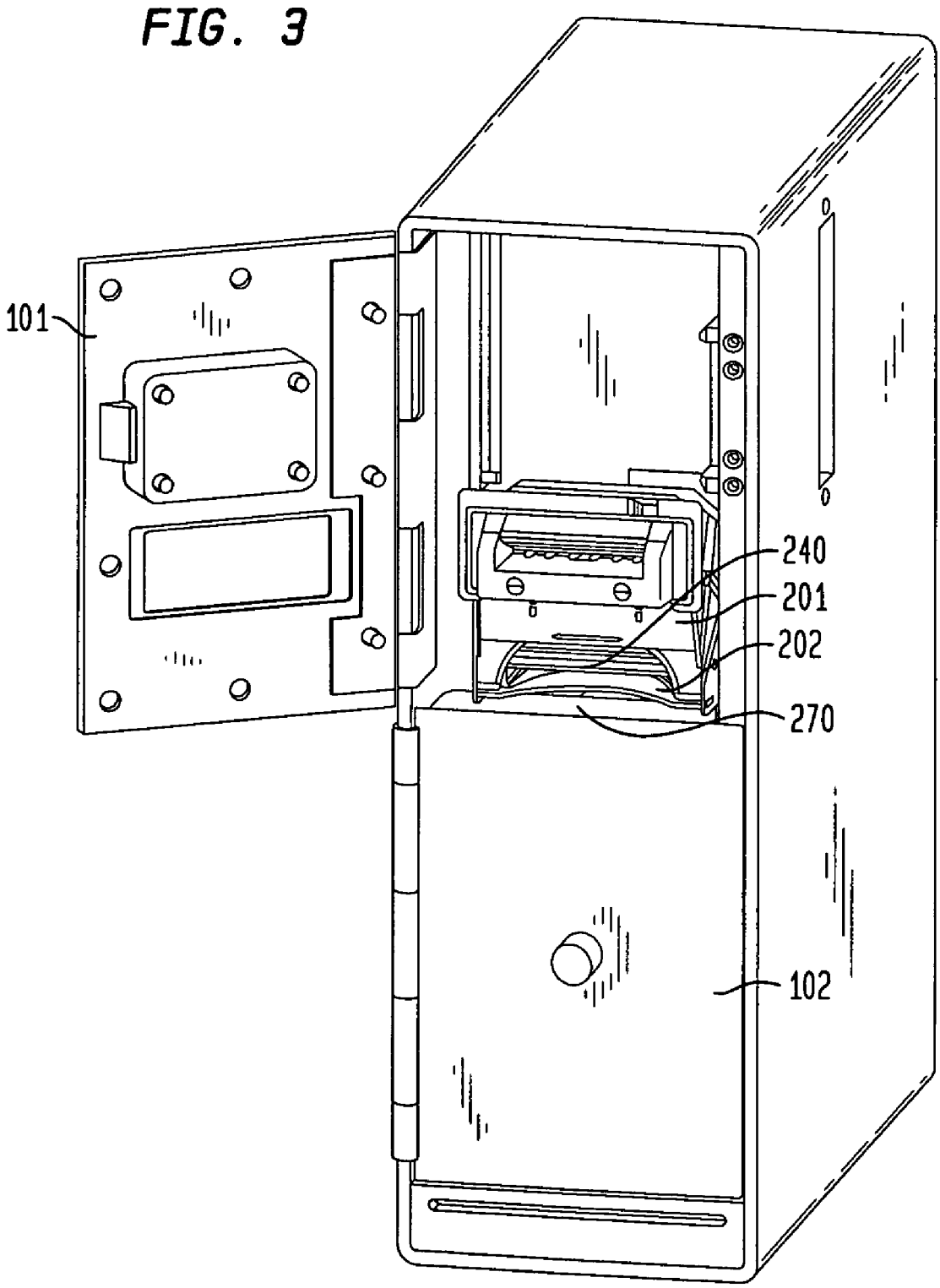
FIG. 3 shows the electronic drop safe with only the service access door open.

Referring to FIG. 3, the bill acceptor access door 101 is shown in its open position and the cash canister access door 102 is shown in its closed position. The bill acceptor mounting frame 202 can be seen as separating access to the bill acceptor module 201 from access to the cash canister module, which is locked behind the closed cash canister access door 102. Additionally, the reinforcement shelf 270 effectively blocks access to the cash canister by eliminating regions wherein tools may be used to gain access when the bill acceptor access door 101 is open.

The bill acceptor module 201 can be readily removed for service or replacement by pulling out this module once the release rod 240 is lifted. Replacing the bill acceptor module 201 is achieved by simply pushing the unit back in on guide rails provided for that purpose. Control electronics, power supplies, and harnessing are all also housed in this upper region of the electronic safe. No currency is stored in this region of the electronic safe. Unlike conventional electronic safes, this unique configuration allows servicing of the electronic safe through the bill acceptor access door 101 by service personnel or anyone authorized to service the equipment. The key used to gain access to the upper region of the electronic crop safe 100, whether it is mechanical or electronic is different from the key used to gain access to the cash canister door 102, insuring the security of cash in the safe. Authorized service personnel with access to the cash acceptor access door 201 can be allowed to service the electronic safe without having to first secure or retrieve the collected money. This advantageous arrangement eliminates the requirement that the store manager or an armored collection service be called and their presence arranged before a service call on the equipment can be made. This arrangement also allows service personnel to service equipment at their convenience, whenever the facility is accessible, which can be up to 24 hours a day.

Figure 4:
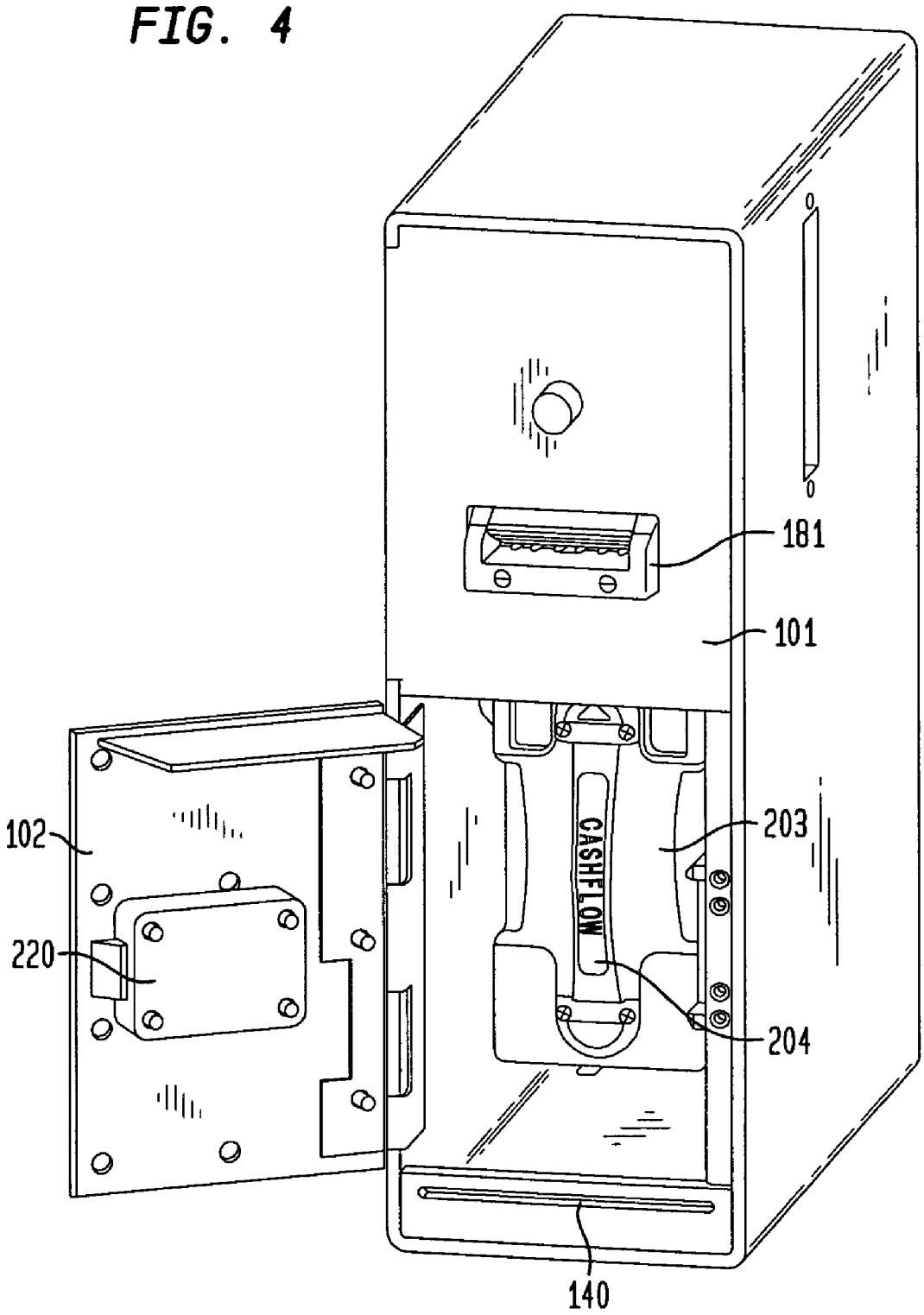
FIG. 4 shows the electronic drop safe with only the cash access door open.

FIG. 4 illustrates the safe 100 of the current invention with the cash canister access door 102 open and the bill acceptor access door 101 closed. The cash canister 203 is now accessible and a collection can be made. The cash canister 203 is removed by pulling on the handle 204. A replacement cash canister can then be inserted by pushing the replacement cash canister 203 into the safe 100, so the canister 203 slides along the provided guide rails. The cash canister 203 snaps into place when fully inserted. The key used to gain access to the cash canister access door 102 will be available only to those with authorization to collect the money. The authorized person is usually the manager, an armored collection service, or the like. Of course, a lock can suitably be utilized as the lock 220 which can require two keys, a code and a key or two codes so that both a manager and an authorized person from the armored carrier service be present to gain access. Once the cash canister access door 102 is opened, not only is the cash canister 203 accessible, but also any envelops or funds deposited through the envelope drop opening 140 are accessible. These envelopes or other deposited items will be resting below the cash canister 203 for easy retrieval. The envelope slot can of course be a more sophisticated mechanism for accepting envelopes and the like, such as a motorized acceptor which requires the cashier to enter their identification before depositing the envelope.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

I claim:

1. An electronic drop safe comprising:

a bill acceptor for accepting bills; and a bill canister for storing bills, with both the bill acceptor and the bill canister contained within a housing, whereby:

the bill acceptor is removable through a first access door when the first access door is open; and the bill canister is removable through a second access door when the second access door is open and is not accessible when the second access door is closed.

2. The electronic drop safe of claim 1 wherein said first access door and said second access door have independent locks.

3. The electronic drop safe of claim 2 wherein said independent locks can be mechanical or electronic.

4. The electronic drop safe of claim 1 whereby the majority of serviceable components are located in a first compartment with access through the first access door and isolated from a second compartment housing the bill canister when the second access door is closed.

5. The electronic drop safe of claim 1 whereby the bill acceptor and the cash canister are mounted so that they may be readily removed without the use of tools.

6. An electronic drop safe comprising:

a bill acceptor for accepting bills, the bill acceptor being removable through a first access door;

a bill canister for storing bills, the bill canister being removable through a second access door, internal electronics for control or interfacing to internal or external components; and harnessing to at least interconnect said internal electronics to said bill acceptor, whereby said internal electronics and said harnessing are housed along with the bill acceptor within a first compartment accessible through the first access door, the first compartment being isolated from the bill canister for storing bills when the second access door is closed.

7. The electronic drop safe of claim 6 whereby the majority of serviceable components are located in the first compartment with access through the first access door.

8. The electronic drop safe of claim 6 whereby the serviceable components are mounted so that they may be readily removed, serviced and replaced without the use of tools.

9. An electronic drop safe comprising:

a bill acceptor for accepting bills; and a bill canister for storing bills wherein:

said bill acceptor is removable through a first access door; and said bill canister is mounted on guide rails and is removable through a second access door, whereby said bill canister may be slidably removed and replaced without the use of tools.

10. An electronic drop safe comprising:

a bill acceptor for accepting bills mounted in a first compartment within a housing; and a bill canister for storing bills mounted in a second compartment within the housing, wherein said bill canister is located behind an access door, whereby said access door has no external openings other than a key access and isolates said bill canister from the bill acceptor when the access door is closed.

11. The electronic drop safe of claim 10 wherein said access door further comprises a reinforcement shelf.

12. The electronic drop safe of claim 10 wherein the bill acceptor is separated from the bill canister along a dividing plate which is a part of a mounting frame.

13. The electronic drop safe of claim 10 wherein said bill canister is mounted on guide rails and is slidably removable through said access door when the access door is open.

14. The electronic drop safe of claim 10 wherein said bill acceptor is mounted on guide rails and is slidably removable through a second access door when the second access door is open.

* * * * *